US005123651A

United States Patent [19]

Vinciguerra

[11] Patent Number: 5,123,651

[45] Date of Patent: Jun. 23, 1992

[54] GOLF PRACTICE APPARATUS

[76] Inventor: Joseph F. Vinciguerra, 9 William St., Andover, Mass. 01810

[21] Appl. No.: 748,434

[22] Filed: Aug. 22, 1991

[51] Int. Cl.[5] ..... A63B 67/02

[52] U.S. Cl. ..... 273/176 R; 273/176 H; 273/179 C; 273/178 R

[58] Field of Search ..... 273/176 R-176 L, 273/195 R-195 B, 32 R, 34 R, 177 R-179 E, 181 R, 181 A, 181 F, 182 R, 182 A, 35 R, 183 A

[56] References Cited

U.S. PATENT DOCUMENTS

| | | | |
|---|---|---|---|
| 2,912,248 | 11/1959 | DiBuono | 273/176 F |
| 3,275,325 | 9/1966 | MacKenzie | 273/179 C |
| 3,430,964 | 3/1969 | Budzinski | 273/176 F |
| 3,469,334 | 9/1969 | Kategian | 273/179 R |
| 3,558,139 | 1/1971 | Brandell | 273/178 |
| 3,831,949 | 8/1974 | Henning | 273/176 B |
| 3,871,650 | 3/1975 | Casey | 273/178 B |
| 3,944,232 | 3/1976 | Tierney | 273/176 B |
| 4,538,814 | 9/1985 | Cunningham | 273/176 F |
| 4,906,006 | 3/1990 | Sigunick | 273/178 R |
| 5,016,884 | 5/1991 | Psiol et al. | 273/176 B |

*Primary Examiner*—Paul E. Shapiro
*Assistant Examiner*—Steven B. Wong
*Attorney, Agent, or Firm*—Edward A. Gordon

[57] ABSTRACT

The present invention provides a golf putting apparatus which in one embodiment provides a golf putting device which is portable and can be used indoors and outdoors and in a second embodiment provides a golf practice apparatus including a cage in which the putting device is inserted to thereby provide a practice apparatus in which the player can practice putting, driving and chipping. The present golf putting simulator device includes an elongated body member which tapers from the back end where the ball is putted to the front end where a golf ball cup-like opening is provided. The body member includes an upper putting surface and channel members which extend along each side of the body member from the forward portion to the rearward portion. Each channel member is provided with a base surface which is positioned angularly to slant from a high forward end position to a low back end position whereby golf balls entering either channel will gravitate from the forward end to the rearward end. The putting device also includes releasable channel insert blocks whereby the distance that the golf balls roll down the channels can be selected by the player. Additionally the cup-like golf ball hole is provided with a channel member which is connected to one of the side channels so that when a golf ball is putted into the cup-like hole it will return. The bottom surface of the body member is provided with a plurality of adjustable foot members so that the slope or angle of the putting surface can be varied. This putting device feature of the present invention also includes foot stands for the player which simulate various ground angles and heights.

7 Claims, 6 Drawing Sheets

FIG.6
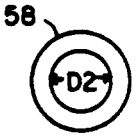
FIG.5
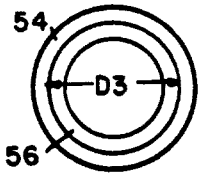
FIG.4
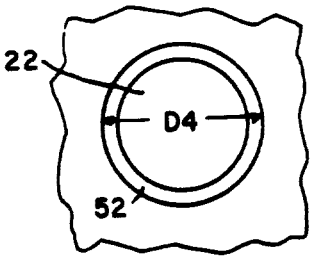
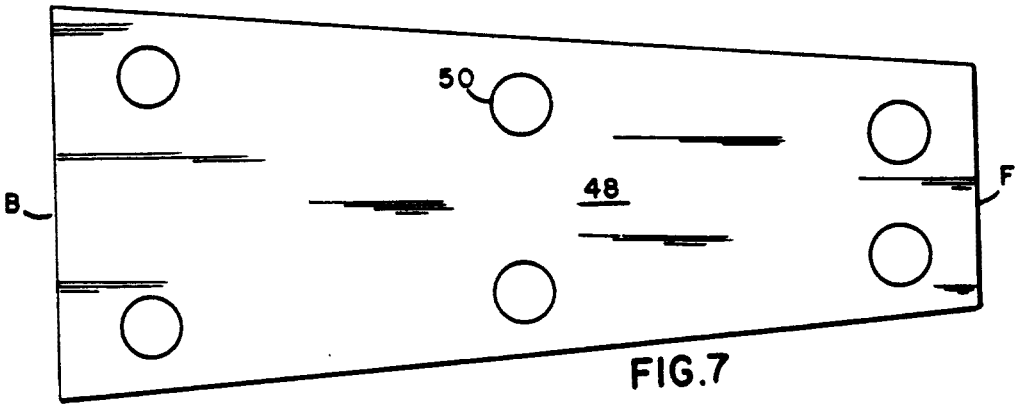
FIG.7
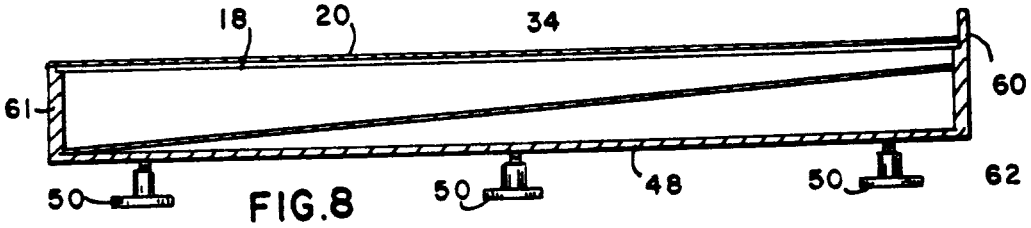
FIG.8
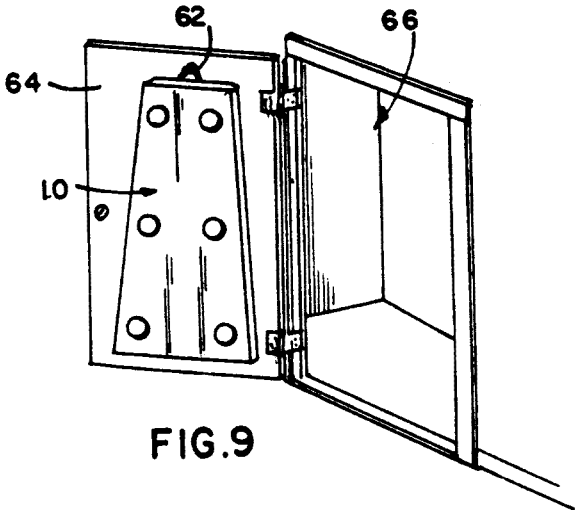
FIG.9

GOLF PRACTICE APPARATUS

BACKGROUND OF THE INVENTION

1. Field Of The Invention

The present invention relates to golf practice apparatus and more particularly to a new and improved golf putting apparatus which can be used indoors or outdoors and which can be adjusted to vary the nature of the shots which can be practiced.

2. Description Of Prior Art

Heretofore various games have been developed for improving one's skill in golf putting, driving or chipping and many of these games may be set up indoors. Usually the devices are quite large and are difficult to store. Those which are relatively small do not provide the challenge of the larger games and are not as interesting.

Many devices have been developed for perfecting one's putting indoors and outdoors, but using many devices of this nature is not very interesting and becomes boring since the nature of the shots which can be practiced including the position of the player are limited.

While such prior art devices provide improvement in the areas intended, there still exists a need for a golf practice apparatus which overcomes the disadvantages of the prior art while providing utility features which provide new and useful advantages and improvements not heretofore disclosed.

Accordingly, a principle desirable object of the present invention is to provide a new and improved golf practice device which overcomes some or all of the disadvantages of the prior art devices.

Another desirable object of the present invention is to provide a golf practice device which may be played indoors in a relatively small surface area.

Another desirable object of the present invention is to provide a golf practice device which is interesting to play.

Another desirable object of the present invention is to provide a golf practice device in which the putting surface can be adjusted to vary the height and angle of the platform which forms the putting green and cup-like hole.

Another desirable object of the present invention is to provide a golf practice device which includes golfer foot stands which simulate various ground angles and heights.

A further desirable object of the present invention is to provide a golf practice device which permits the user to practice putting, driving and chipping and determine perfection and defects.

Another desirable object of the present invention is to provide a golf practice device which employs golf balls and which is constructed and arranged so that the golf balls will be automatically returned to the particular positions from which the golfer puts the golf ball.

Another desirable object of the present invention is to provide a golf putting device which can be used separately for putting practice and which is readily and easily portable.

Another desirable object of the present invention is to provide a golf practice apparatus in accordance with the foregoing desirable objects that in part provides a putting device and in combination provides a tri-functional device and which may be economically manufactured and be of durable character.

These and other desirable objects of the present invention will in part appear hereinafter and will in part become apparent after consideration of the specification with reference to the drawings and the claims.

SUMMARY OF THE INVENTION

The present invention provides a golf putting apparatus which in one featured embodiment provides a new and improved golf putting device which is portable and can be used indoors and outdoors and a second featured embodiment is a golf practice apparatus including a cage in which the putting device is inserted to thereby provide a practice apparatus in which the player can practice putting, driving and chipping.

With the foregoing features in view, the present invention provides a golf putting simulator device comprising an elongated body member which tapers from the back end where the ball is putted to the front end where a golf ball cup-like opening is provided which is variable in size to receive the golf ball. The elongated body member includes an upper putting surface along which a golf ball can be putted toward the cup-like hole which is formed in the upper surface. The body member includes channel members which extend along each side of the body member from the forward portion to the rearward portion. Each channel member is provided with a base surface which is positioned angularly to slant from a high forward end position to a low back end position whereby when a golf ball enters either channel it will gravitate from the forward end to the rearward end. The putting device also includes releasable channel insert blocks whereby the distance that the golf balls roll down the channels can be selected by the player. Additionally the cup-like golf ball hole is provided with a channel member which is connected to one of the side channels so that when a golf ball is putted into the cup-like hole it will return. The bottom surface of the body member is provided with a plurality of adjustable foot members so that the slope or angle of the putting surface can be varied. This putting device feature of the present invention also includes foot stands for the player which simulate various ground angles and heights. The foot stand device includes one unit upon which the player places both feet or two separate stands, one for each foot. The foot stands include adjustable foot member supports for adjusting the height and angle of the player's feet to simulate various ground levels.

The present invention also includes a golf practice enclosure apparatus in which standard golf clubs and golf balls can be used. The apparatus includes an elongated base member having a generally rectangular configuration and an upper flat surface having an opening in the forward half portion configured to releasably receive the golf putting device. A cage netting is connected to the forward portion of the base member so as to enclose the sides, forward and top area of the forward portion of the base member. A flexible tee member having an upper end for receiving a golf ball is releasably attachable to various positions on the upper surface of the base member and back from the rear end of the putting device.

The rearward portion of the base member is provided with vertical wall members which extend across the rear end of the base member and forward along equal portions of the sides of the base member to provide a partially enclosed section for the players and their equipment. The apparatus further includes a top cover member and a forward and side cover member which extends from the front end of the base member back to contact with the player enclosure section. The top cover member and forward and side cover member permit the golf practice apparatus to be used outside during unsatisfactory weather conditions.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein:

FIG. 4 is an enlarged fragmentary top plan view of the circular opening which serves as a golf cup in accordance with the present invention;

FIG. 5 is a top plan view of a first ring device for insertion into the cup device of FIG. 4 to reduce the size of the opening;

FIG. 6 is a top plan view of a second ring device for insertion into the first ring device to further reduce the size of the cup opening;

FIG. 7 is a bottom plan view of the putting device of FIG. 1;

FIG. 8 is a cross-sectional view of the putting device taken along the line 8—8 of FIG. 1;

FIG. 9 is a fragmentary perspective view of the putting device of FIG. 1 releasably attached to a conventional closet door;

DETAILED DESCRIPTION OF PREFERRED EMBODIMENT(S)

Figure 1:
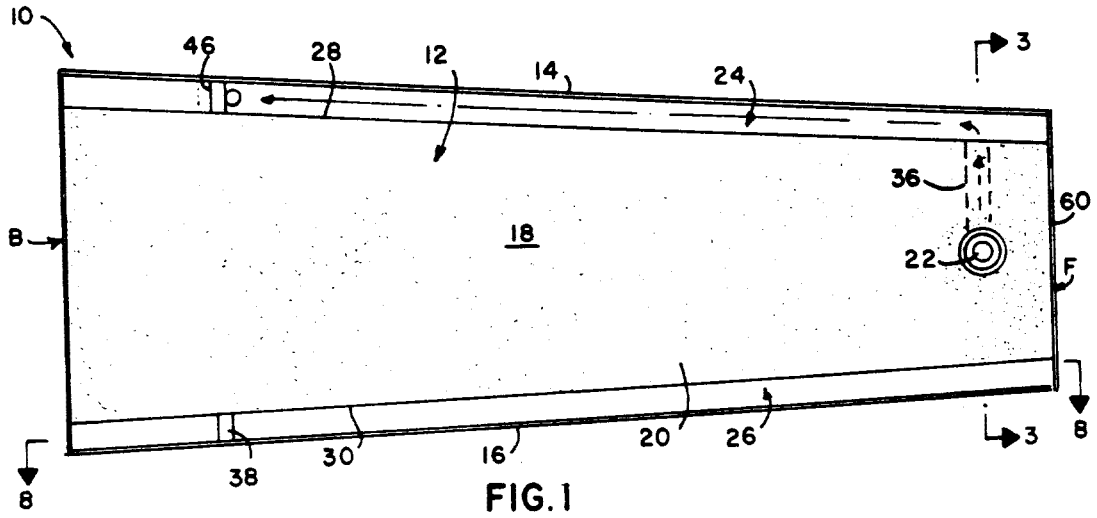
FIG. 1 is a top plan view of the golf putting device in accordance with the present invention.

Referring now to the drawings and more particularly to FIGS. 1–9, there is illustrated a golf putting simulator device indicated generally by the numeral 10. The putting device 10 is an elongated body member 12 with elongated side wall members 14 and 16 which together taper from the back end B to the front end F. The body member 12 includes an upper flat putting surface member 18 which is preferably covered with a grass like simulating layer 20 such as felt or the like covering material. The front end of the flat putting surface member 12 is provided with a centrally disposed circular hole 22 which communicates with the interior of the body member 12. The body member 12 includes elongated side channel members 24 and 26 which have an open top area and extend along each side of the body member 12 from the front end F to the rear end R. The channel members 24 and 26 are each defined respectively by the side members 28 and 30 of the body member 12, the side wall members 14 and 16, and base surface members 32 and 34 each of which are positioned angularly to slant or slope downwardly from a high front end position to a low back end position whereby when a golf ball travels off the upper putting surface to a channel member, it will gravitate from, for example, the forward position to the rear end of the particular channel member. In connection with this feature of the invention, the cup-like hole 22 is provided with a descending tubular channel member 36 which is connected to one of the side channels such as, for example, channel 24 so that when a golf ball is putted into the cup-like hole 22 it will travel by gravitation through channels 36 and 24 and return to the player's position. The rear wall frame member 61 prevents the golf ball from rolling any further. Similarly, the front end of the putting device includes a wall frame member 60 which extends above the putting surface 18 and serves as a backstop to prevent a golf ball from being putted off the front end.

In a preferred embodiment, the putting device 10 is provided with a releasable channel insert block member whereby the distance that the golf balls roll down the side channels 24 and 26 can be selected by the player adjacent to where the player is standing to putt the golf balls.

Figure 2:
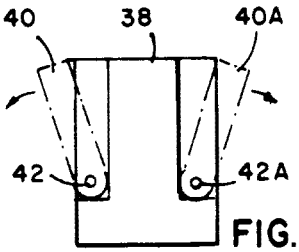
FIG. 2 is an enlarged front elevational view of the golf ball channel blocking device of FIG. 1.
Figure 2A:
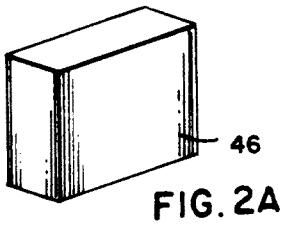
FIG. 2A is a perspective view of an alternate embodiment of a golf ball channel blocking device.

FIG. 2 illustrates an embodiment of an insert block member 38 which has an outer shape which conforms to the shape of the channels 24 and 26 when inserted into the channels. The sides of the block member 38 are provided with arm members 40 and 40A which are rotatably attached to the base of the block by spring rotatable coupling members 42 and 42A which releasably hold the block members in the channels. FIG. 2A illustrates another insert block member 46 which in accordance with the present invention is a single unit configured to channels and of sufficient weight so as not to move when inserted in the channels.

Figure 3:
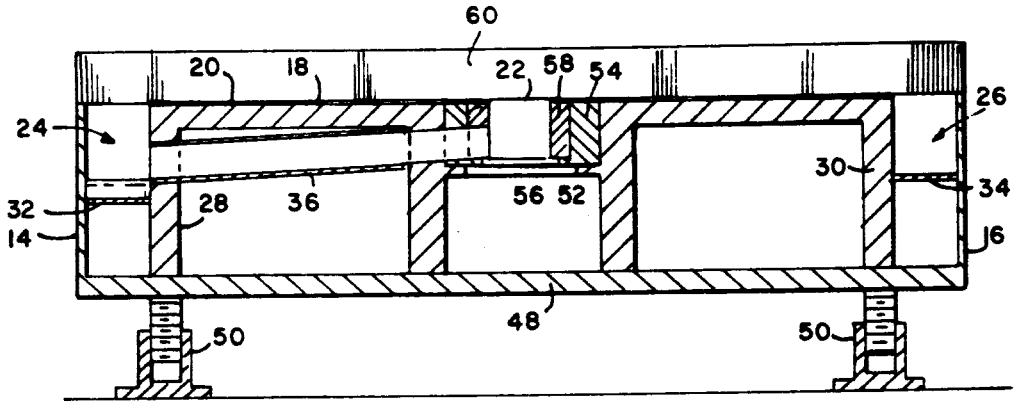
FIG. 3 is a cross-sectional view taken along the line 3—3 of FIG. 1.

As best seen in FIGS. 3, 7 and 8, the bottom frame surface member 48 of the body member 12 is provided with a plurality of adjustable foot members 50 so that the slope or angle of the putting surface can be varied. The foot members 50 can be screw adjustable as best illustrated in FIG. 3.

Referring now more particularly to FIGS. 3–6, the golf putting device 10 of the present invention is provided with a golf ball cup-like opening 22 which connects with channel 24 by means of channel 36. The opening 22 has a circular base support member 52 which has a diameter D4 of four inches. The base support 52 provides support for ring member 54. Ring member 54 has an upper inner diameter D3 of three inches and provides a lower circular base support member 56 which supports ring member 58. Ring member 58 has an inner diameter D2 of two inches. These features of the invention permit the player to quickly and easily vary the size of the golf ball cup-like opening 22.

As illustrated in FIG. 9, when the golf putting device 10 is formed with a length of approximately six feet, the front end frame member 60 can be provided with a hook means 62 for attaching the putting device 10 to a door 64 such as a home door for a closet 66. In this manner, the player can have easy and convenient access to the putting device 10 especially when it is to be used in the home. It is to be understood that one feature of the golf practice enclosure apparatus 74 discussed hereinafter is that the putting device 10 is easily removable to use for putting practice inside or outside of the player's home, for example.

Figure 11:
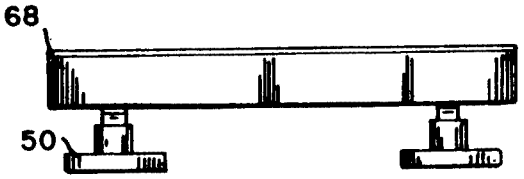
FIG. 11 is a front elevational view of the single foot stand of FIG. 10.
Figure 10:
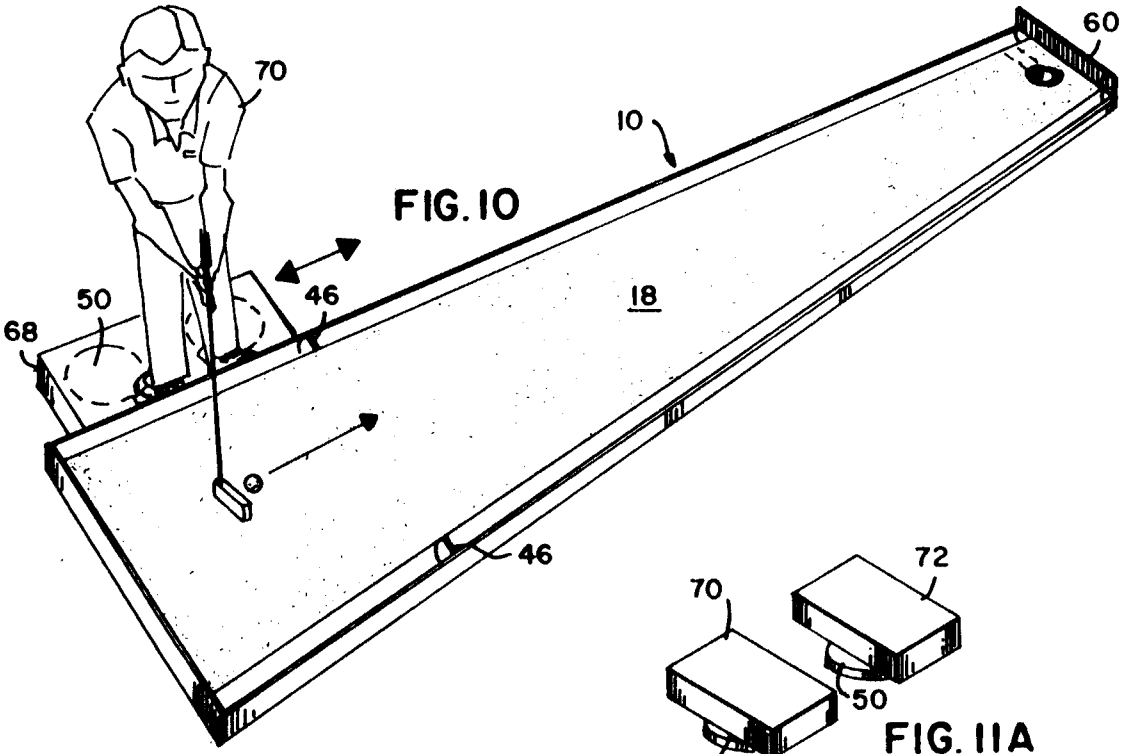
FIG. 10 is a perspective view of the golf putting device with a player and further including two embodiments of foot level standing devices for the player in accordance with the present invention.
Figure 11A:
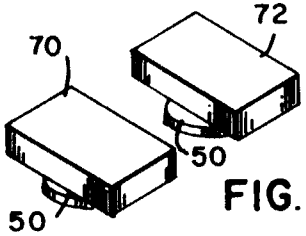
FIG. 11A is a perspective view of the player's two piece foot stand.

Referring now more particularly to FIGS. 10, 11 and 11A, there is illustrated a feature of the present invention which is directed to putting device foot stands for the player which simulate various ground angles and heights for the player's feet. In one embodiment, the foot stand is a single unit device 68 upon which the player 70 places both feet. The foot stand 68 is provided with at least two adjustable foot members 50 for adjusting the height and angle of the player's feet with respect to the upper putting surface 18 to simulate various ground levels. In the other embodiment as shown in FIG. 11A, the player's foot stand comprises two separate stands 70 and 72 which are each provided with at least one adjustable foot member support 50.

Referring more particularly to FIGS. 12–15, there is illustrated a second featured embodiment of the present invention which is a golf practice enclosure apparatus, illustrated generally by the numeral 74, in which the golf putting device 10 can be easily inserted or removed. As partly discussed previously, the golf putting simulator device 10 separately serves as a putting practice device which is readily and easily portable to be usable not only outside but also within places such as, for example, homes, golf clubs, public houses and business establishments. When the golf putting device 10 is inserted into the golf practice enclosure apparatus 74 of the present invention, there is provided a golf practice apparatus in which the player can practice putting, driving and chipping under any weather conditions.

The golf practice enclosure apparatus 74 comprises an elongated base member 76 having a generally rectangular configuration including an upper surface member 78, lower support side members 79 and lower support opposing end members 81 and bottom support member 83. The upper surface member 78 of the base member 76 is provided with and defines an opening 80 in the forward portion configured to releasably receive the golf putting device 10. A cage section 82 is attached over the forward portion of the base member 76 and includes a front wall 84, side walls 86 and 88 and top wall 90. The rearward section 95 of the base member 76 is provided with vertical wall members which include a rear wall 92 and side walls 94 and 96 which are preferably at least eight feet in height to provide a partially enclosed area for players and their equipment. An open section 97 is intermediate the cage section 82 and the room section 95 and provides an area wherein a player stands to swing a golf club in contact with a golf ball. The rearward or room section 95 includes a seat member 98 and a door member 100 which is used to enter the rearward room section 95 when the apparatus 74 is enclosed, as discussed hereinafter, due to weather conditions, for example. The apparatus 74 includes a removable roof member indicated generally by the numeral 102 which has a generally rectangular configuration including a forward section 103 configured to be placed over the top of the cage section 82, a rearward room section 105 configured to be inserted over room section 95 and an intermediate section 107 to extend over the intermediate section 97. In the preferred embodiment, the section 107 of the roof member 102 is an expandable telescoping section which extends over the intermediate section 97 between the cage section 82 and the room section 95 where the player stands to swing a golf club. In a situation where a player holds the golf club in a high initial position, or where the player is taller than average, the expandable telescoping roof section 107 can be raised as shown by the dotted lines to accommodate a situation where the golf club is swung, to drive the golf ball, for example, from a position higher than the normal roof sections 103 and 105. The base member 76, room section 95 and roof member 102 can be made of wood panels, for example. The roof member 102 can also be formed of a plastic material. The apparatus 74 further includes an enclosure member 104 which includes a front wall 106 and two side walls 108 and 110 which are formed of wood or plastic materials. The side walls 108 and 110 have lower extension sections 112 and 114 which together with side wall end sections 116 and 118 support the vertical transparent plastic members 120 and 122. When the weather is unsatisfactory, the cover member 102 and enclosure member 104 are attached to the base member 74 to permit the golf practice apparatus to be used outside during unsatisfactory weather conditions. As shown by the arrows in FIG. 12, the enclosure member is slid into position along the top of horizontal members 120 and 122 which extend outwardly from the base member 76.

Figure 13:
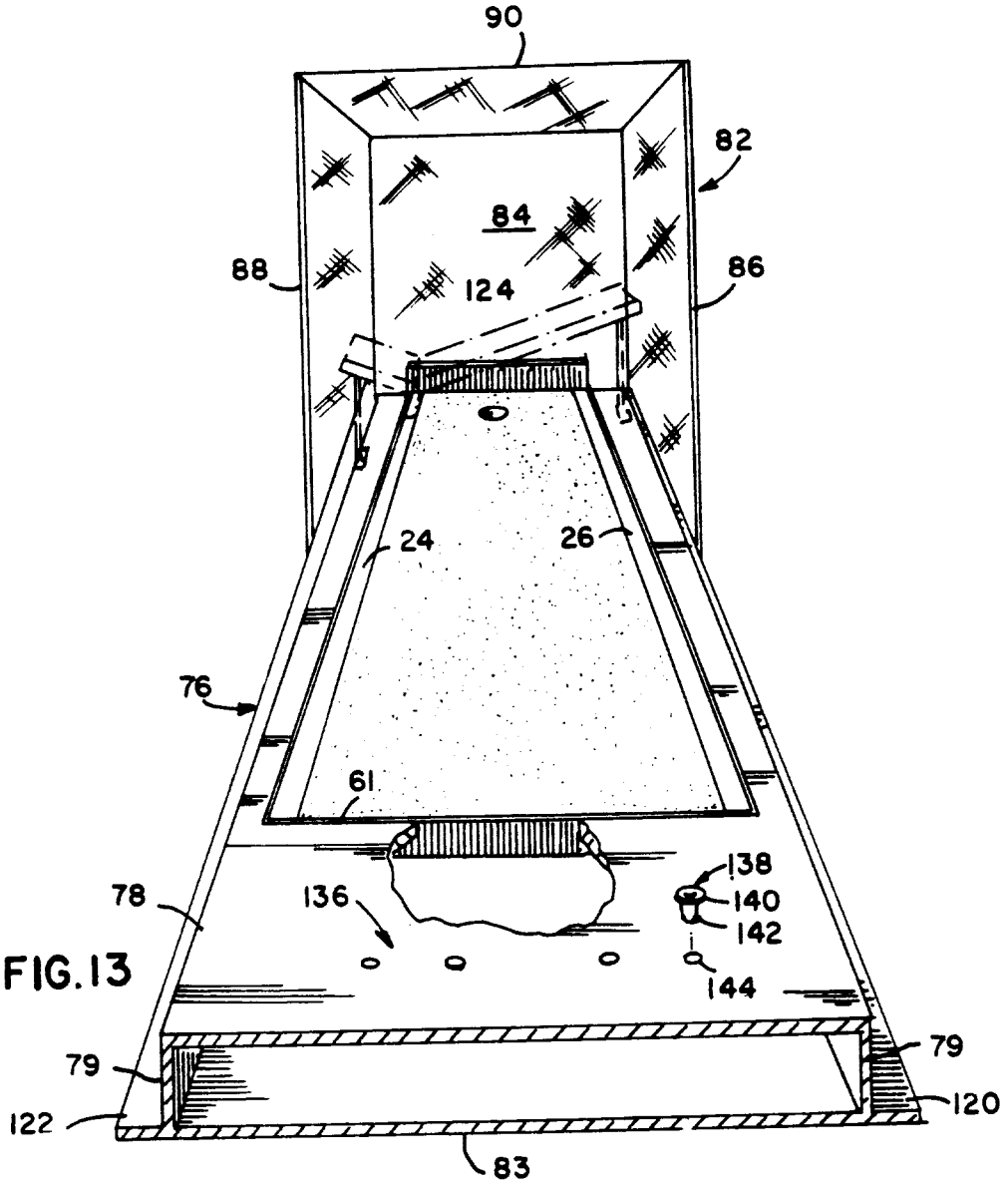
FIG. 13 is a fragmentary inside view of the cage as seen from the player's position for putting, driving and chipping.
Figure 14:
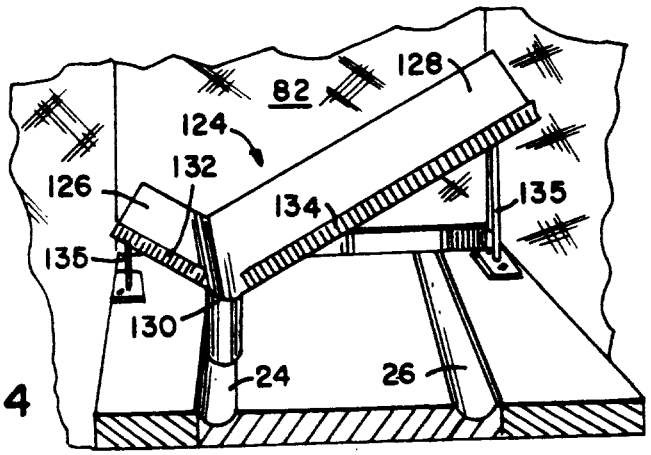
FIG. 14 is a fragmentary perspective view of the golf ball return device as shown in phantom in FIG. 13 located at the end of the cage and below the primary impact area.
Figure 15:
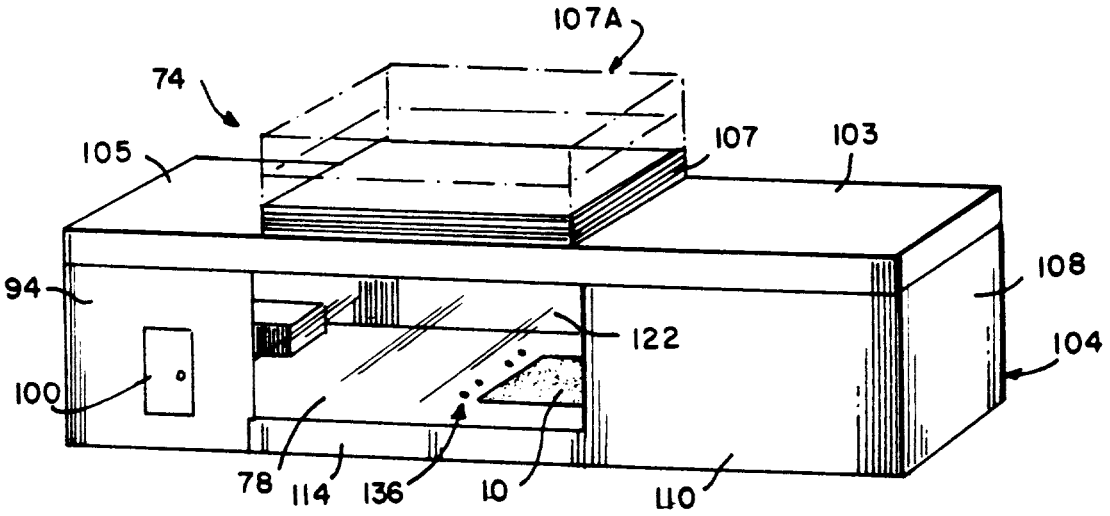
FIG. 15 is a perspective view of the entire golf practice apparatus of the present invention as shown in FIG. 12.

As best seen in FIGS. 13 and 14, the base member 76 includes a golf ball receiving platform 124 (shown in dotted lines in FIG. 13) which is attached to the front end of the golf apparatus base nenber 76. The receiving platform 124 includes two side members 126 and 128 which are inlcined downwardly and forwardly from each side to a common contact point which forms a trough section 130 which is declined or slopes downwardly to contact a channel member such as channel 24. The forward ends of the side members 126 and 128 are provided with raised edge members 132 and 134 whereby golf balls which are driven or chipped to the end of the cage 82 and drop into the receiving platform 124 are directed to the trough section 130 then to the channel 24 which returns the ball to rear end panel 61 of the putting device 10. The golf ball receiving platform 124 is attached in position at the forward end of the base member 76 by support members 135 which are bolted to the upper surface member 78.

Figure 12:
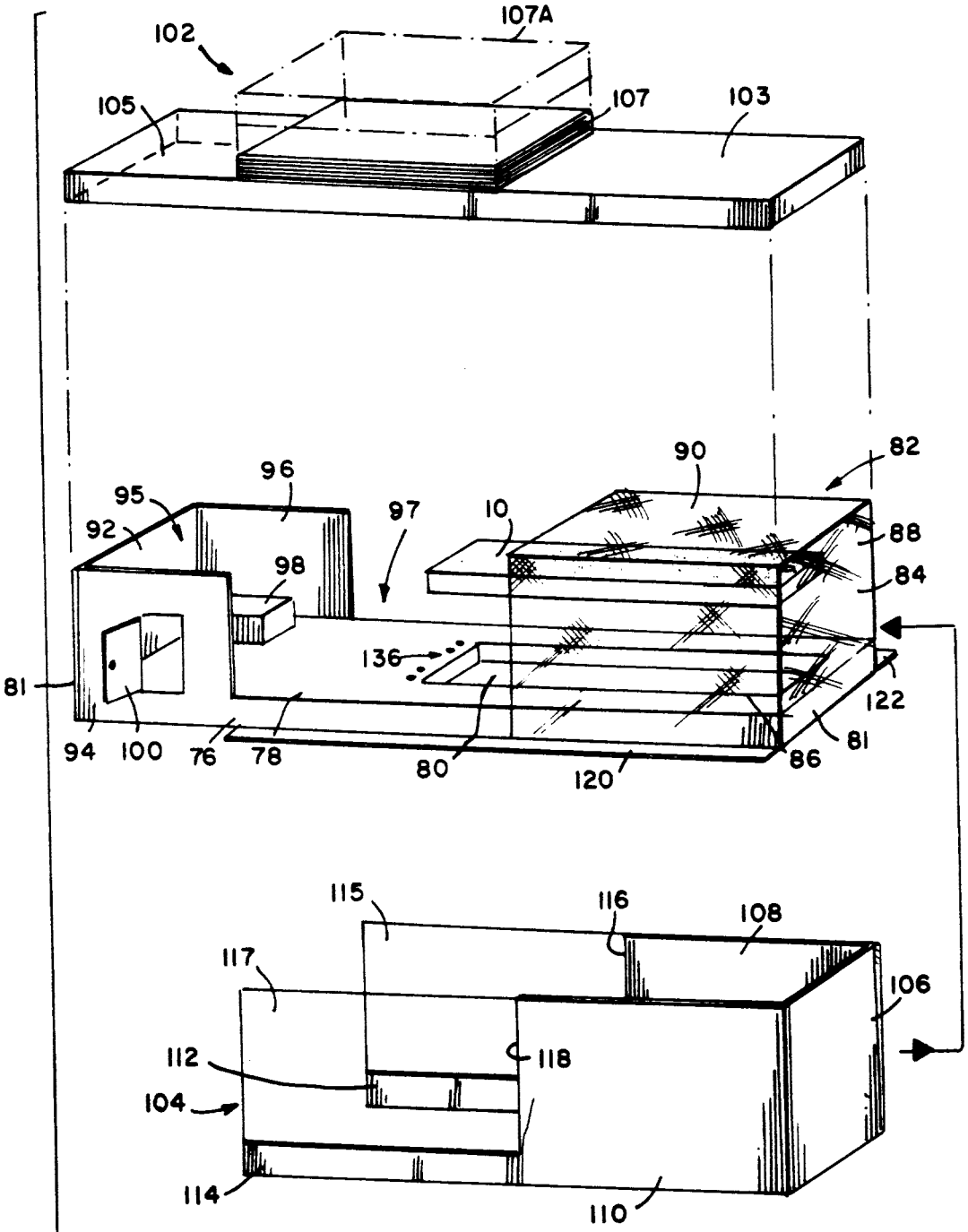
FIG. 12 is an exploded perspective view of one embodiment of the entire golf practice apparatus of the present invention for golf putting, driving or chipping practice and showing the general arrangements of the various components.

Referring now to FIGS. 12 and 13, the base member 76 includes a tee off section 136 from which the golf balls may be driven or chipped. The tee off section includes flexible tee members 138 which can be formed of flexible rubber or plastic material and which has a top cup portion 140 to hold a golf ball and an elongated leg portion 142 which is partially insertable into one of the selected openings 144 in the upper surface member 78.

While the invention has been described with respect to preferred embodiments, it will be apparent to those skilled in the art that changes and modifications may be made without departing from the scope of the inveniton herein involved in its broader aspects. Accordingly, it is intended that all matter contained in the above description, or shown in the accompanying drawing shall be interpreted as illustrative and not in limiting sense.

What is claimed is:

1. A golf practice enclosure apparatus comprising:

an elongated base member having a generally rectangular configuration;

said base member including an elongated top flat surface member;

said top flat surface member including an open area in the forward portion extending forwardly and configured to releasably receive a golf putting simulator device;

a golf putting simulator device releasably contained within said open area of said top flat surface member, said golf putting simulator device comprising:

(a) an elongated body member with elongated side wall members tapering inwardly from a back wall member to a front wall member, said body member including;

(b) an upper flat surface member constituting a putting surface over which a golf ball can be putted from the back wall member to the front wall member;

(c) a circular hole positioned in the center of the upper surface member adjacent the front wall member of the body member so as to constitute a putting cup-like hole to receive a golf ball; and (d) a channel member positioned along each elongated side wall member and adjacent said upper flat putting surface member from the front wall member to the back wall member of the body member whereby a golf ball traveling off the flat putting surface to a channel is returned to the back wall of the channel members;

a cage member having front, sides, and top sections attached over the front portion of the base member to thereby contain driven and chipped golf balls;

a room section for players having a back and side walls attached to the back portion of said base member;

a tee off means positioned on said top flat surface member adjacent the back wall of said putting simulator device to permit driving and chipping; and a golf ball receiving and return means attached above the front end of the base member within the cage member whereby golf balls striking the forward cage member are conducted to a return channel of said putting simulator device.

2. A golf practice enclosure apparatus comprising:

an elongated base member having a generally rectangular configuration;

said base member including an elongated top flat surface member, lower support side members, front and back end members, and a bottom support member;

said top flat surface including an open area in the forward portion configured to releasably include a golf putting simulator device:

a golf putting simulator device releasably contained within said open area of said top flat surface member, said golf putting simulator device comprising:

(a) an elongated body member with elongated side wall members tapering inwardly from a back wall member to a front wall member, said body member including;

(b) an upper flat surface member constituting a putting surface over which a golf ball can be putted from the back wall member to the front wall member;

(c) a hole positioned in the center of the upper surface member adjacent the front wall member of the body member so as to constitute a putting cup-like hole to receive a golf ball; and (d) a channel member positioned along each elongated side wall member and adjacent said upper flat surface member from the front wall member to the back wall member of the body member whereby a golf ball traveling off the flat putting surface to a channel is returned to a back wall of the channel members;

a cage section having front, side, and top members attached over the front portion of said base member to thereby contain driven and chipped golf balls;

a room section for players having a back and side walls attached to the back portion of said base member;

an open section intermediate said cage member and room section wherein a player stands to swing a golf club in contact with a golf ball;

a plurality of holes spaced on each side of the center of the top flat surface member in the forward portion of said open section and including flexible tee members partially inserted in said holes and from which a golf ball may be driven and chipped; and a golf ball receiving and return means attached to the front of the base member within the cage member whereby chipped and driven golf balls striking the forward cage member are conducted to a return channel of said putting simulator device.

3. The gold practice enclosure apparatus according to claim 2 wherein said upper flat surface member includes an artificial grass surface.

4. The golf practice enclosure apparatus according to claim 2 further including a removable enclosure member for the front and sides of the cage member and the sides of the open section.

5. The golf practice enclosure apparatus according to claim 2 further including a removable roof member configured to be placed over the top of the cage, intermediate, and room sections.

6. The golf practice enclosure apparatus according to claim 5 wherein the roof member includes an upwardly expandable section over the open intermediate section.

7. The golf practice enclosure apparatus according to claim 2 further including a platform attached above the forward end of the base member adjacent the cage member; said platform including side members inclined downwardly and rearwardly whereby chipped and driven golf balls are returned to a return channel of the golf putting device.

* * * * *